US008517005B2

(12) United States Patent
Chu

(10) Patent No.: US 8,517,005 B2
(45) Date of Patent: Aug. 27, 2013

(54) STRUCTURE OF GRENADE FOR TOY GUN

(75) Inventor: Chen Tang Chu, Taichung (TW)

(73) Assignee: I Chih Shivan Enterprise Co., Ltd., Taichung (TW)

( * ) Notice: Subject to any disclaimer, the term of this patent is extended or adjusted under 35 U.S.C. 154(b) by 189 days.

(21) Appl. No.: 13/234,160

(22) Filed: Sep. 16, 2011

(65) Prior Publication Data

US 2013/0068208 A1 Mar. 21, 2013

(51) Int. Cl.
*F41B 11/06* (2006.01)

(52) U.S. Cl.
USPC ..... 124/65; 124/56; 124/71

(58) Field of Classification Search
USPC ..... 124/56–57, 64–65, 69–73
See application file for complete search history.

(56) References Cited

U.S. PATENT DOCUMENTS 2,487,053 A * 11/1949 Hickman ..... 102/379
6,732,463 B2 * 5/2004 Dixon et al. ..... 42/1.08
7,784,455 B1 * 8/2010 Chong ..... 124/73
2010/0199960 A1 * 8/2010 Chong ..... 124/57
2012/0037138 A1 * 2/2012 Huebl ..... 124/56
2013/0068207 A1 * 3/2013 Chu ..... 124/45

* cited by examiner

*Primary Examiner* — Michael David
(74) *Attorney, Agent, or Firm* — Leong C. Lei

(57) ABSTRACT

A grenade for toy gun generally includes a bullet compartment having multiple circumferentially arranged accommodation cylinders to receive BB bullets or paintballs therein, a storage chamber forming circumferential raised walls, and an actuation rod assembly that is hollow and has a front end forming an air inlet opening in which a check valve is mounted and a rear end forming an air output opening and circumferential gasket rings. The gasket rings are respectively set in engagement with the raised wall to hermetically seal the storage chamber. Compressed air is fed through the air inlet opening and is discharged through the air output opening to accumulate in the storage chamber. In percussion, the actuation rod assembly is caused to move forward to disengage the gasket ring from the raised wall so as to release the compressed air to instantaneously eject the BB bullets or paintballs received in the bullet compartment.

5 Claims, 8 Drawing Sheets

STRUCTURE OF GRENADE FOR TOY GUN

(a) TECHNICAL FIELD OF THE INVENTION

The present invention generally relates to a structure of grenade for toy gun, and more particularly to a grenade structure that receives compressed air to be filled therein for storage of the compressed air in a storage chamber so that in percussion, the compressed air stored in the storage chamber is released to eject BB bullets or paintballs contained in a magazine compartment, making the operation easy and convenient.

(b) DESCRIPTION OF THE PRIOR ART

Toy guns that are used in survival games for shooting with BB bullets or paintballs are made so real and also exciting, making them widely popular and appealing to the general people. The toy guns that are available in the market for shooting BB bullets or paintballs are often structured for shooting only BB bullets and paintballs in succession. This lowers the interesting and exciting of playing the game. Apparently, a grenade launcher that may simultaneously shoot a number of BB bullets or paintballs provides a strong and heavy fire and is thus more appealing to the game players. One solution is to load a grenade cartridge that contains a number of BB bullets or paintballs and a pressure accumulation structure of compressed air in a grenade launcher and then activate a trigger of the grenade launcher to launch the grenade cartridge so that the compressed air released from the pressure accumulation structure instantaneously project the BB bullets or the paintballs. However, the structure of grenade that is currently adopted is very complicated and further, the launcher is made in a structure for single shot each time. This cannot satisfy the game players who place a strong demand for more advanced firearms.

In view of the above discussed problem, the present invention aims to provide a structure of grenade for toy gun that makes the use and operation of grenade easy and convenient.

SUMMARY OF THE INVENTION

The primary objective of the present invention is to provide a structure of grenade for toy gun, which receives compressed air to be filled in the grenade for storage of the compressed air in a storage chamber so that in percussion, the compressed air stored in the storage chamber is released to eject BB bullets or paintballs contained in a bullet compartment, making the operation easy and convenient.

The grenade for toy gun generally comprises a front cap, a bullet compartment, a storage chamber, and an actuation rod assembly. The bullet compartment comprises a plurality of circumferentially arranged accommodation cylinders to receive BB bullets or paintballs to be loaded therein. The storage chamber forms circumferential raised walls. The actuation rod assembly is hollow and has a front end forming an air inlet opening in which a check valve is mounted and a rear end forming an air output opening and circumferential gasket rings. The gasket rings are respectively set in engagement with the raised wall to hermetically seal the storage chamber, whereby compressed air is allowed to feed through the air inlet opening and the compressed air is discharged through the air output opening to accumulate in the storage chamber. In percussion, the actuation rod assembly is caused to move forward to have the gasket ring disengaging from the raised wall of the storage chamber so as to release the compressed air stored in the storage chamber to instantaneously eject the BB bullets or paintballs received in the bullet compartment.

In the grenade described above, the plurality of accommodation cylinders arranged in the bullet compartment each has a front opening that has an inner side portion to which a flexible rubber ring is mounted so that after the BB bullets or paintballs are positioned into the accommodation cylinders, the flexible rubber rings block and prevent the BB bullets or paintballs from dropping off.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
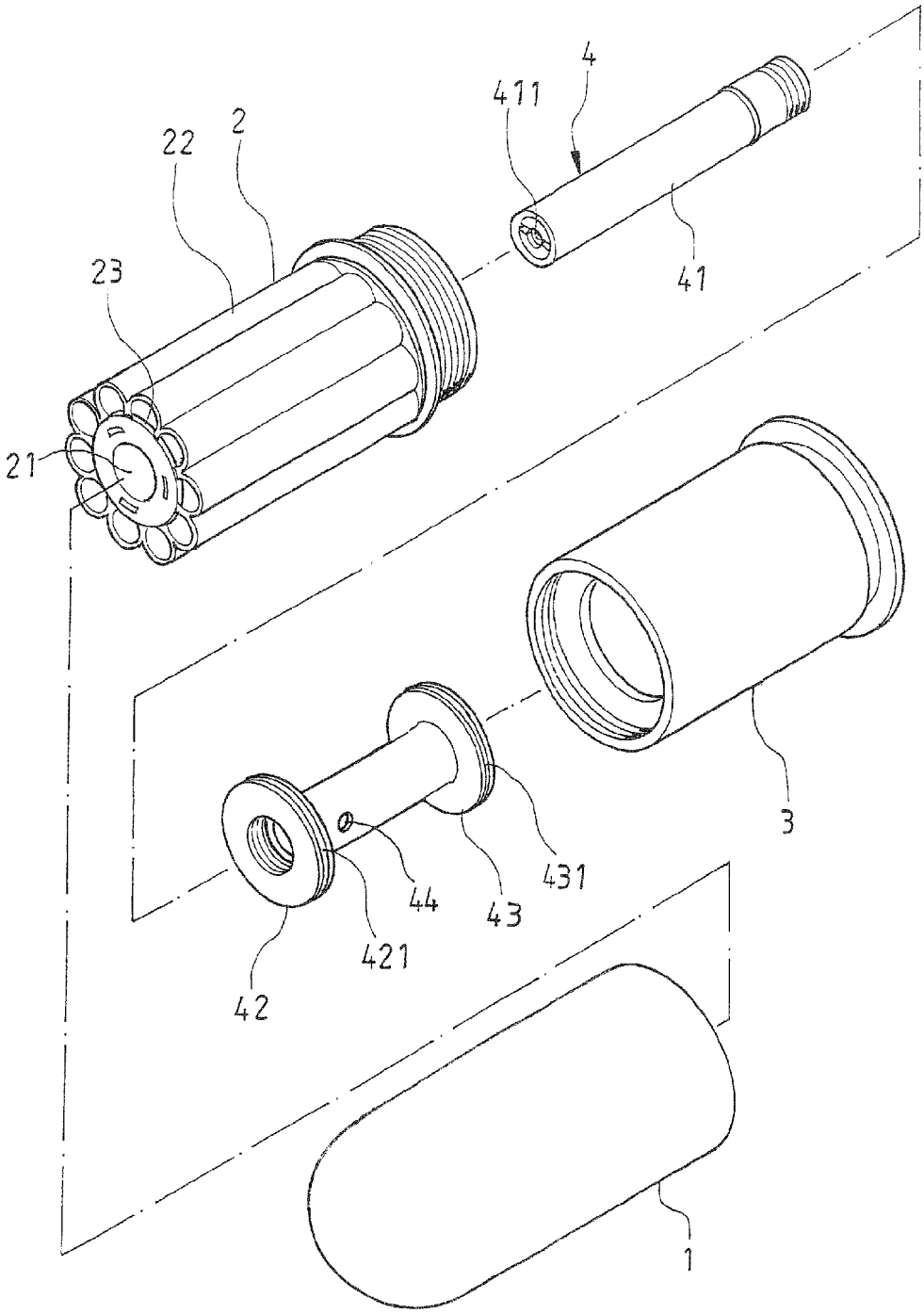
FIGS. 1 and 2 are respectively an exploded view and a perspective view of a grenade according to the present invention.
Figure 2:
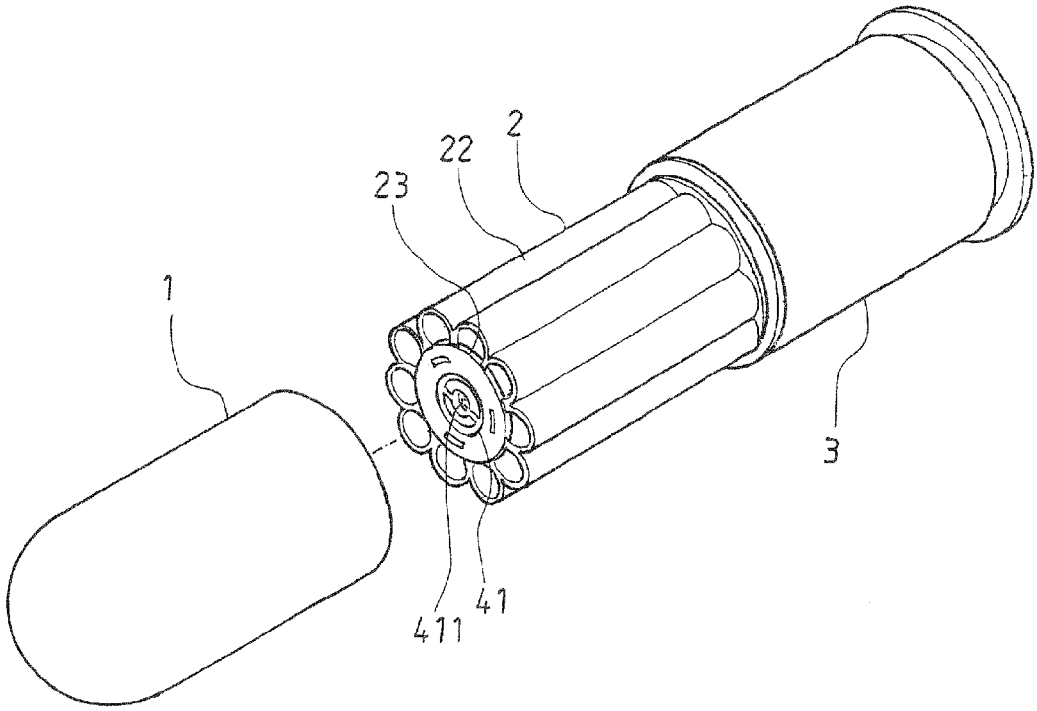
Figure 3:
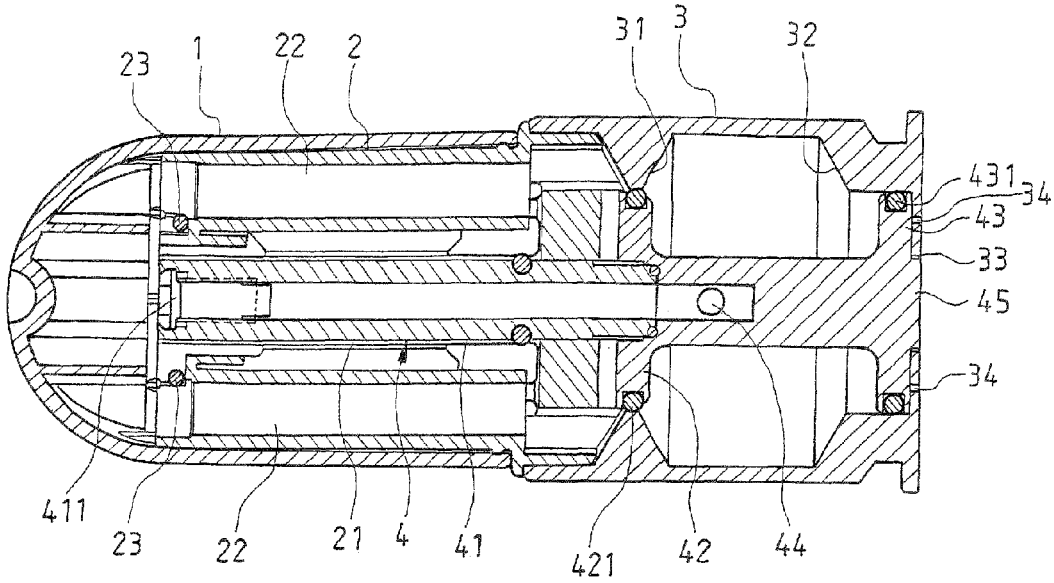
FIG. 3 is a cross-sectional view of the grenade according to the present invention.

Referring to FIGS. 1, 2, and 3, which are respectively an exploded view, a perspective view, and a cross-sectional view of a grenade constructed in accordance with the present invention, these drawings show that a grenade according to the present invention comprises a front cap 1, a bullet compartment 2, a storage chamber 3, and an actuation rod assembly 4. The bullet compartment 2 comprises a centrally-formed through bore 21, which has a circumference around which a plurality of circumferentially arranged accommodation cylinders 22 is arranged to allow each of the accommodation cylinders 22 to receive, via a front opening thereof, and load BB bullets or paintballs therein. The accommodation cylinders 22 are each provided at an inner side portion thereof with a flexible rubber ring 23, so that the BB bullets or paintballs are forced to move through the flexible rubber ring 23 in order to be introduced into each of the accommodation cylinders 22 and through being blocked by the flexible rubber rings 23, the BB bullets or paintballs are not allowed to drop off or separate.

The storage chamber 3 is delimited by a first raised wall 31 and a second raised wall 32 respectively at front end and rear end thereof and forms an opening 33 in the rear end. Further, pressure relief apertures 34 are respectively formed on sides of the opening 33.

The actuation rod assembly 4 is received in the central through bore 21 of the bullet compartment 2 and comprises a hollow air inlet tube 41. The air inlet tube 41 forms, at a front end thereof, an air inlet opening 411 in which a check valve is mounted. The air inlet tube is coupled to a first disk 42 and a second disk 43, which are hollow, and an air output opening 44 is formed between the first disk 42 and the second disk 43. The first disk 42 and the second disk 43 each have a circumference around which a gasket ring 421, 431 is mounted and have an end forming a projection 45 to be fit into the opening 33 of the storage chamber for positioning purposes.

With the above described components being properly assembled, a structure of grenade for toy guns is formed. In a normal condition, the gasket ring 421, 431 on the first disk 42 and the second disk 43 of the actuation rod assembly 4 are in engagement with the first raised wall 31 and the second raised wall 32 of the storage chamber 3 to thereby hermetically seal the storage chamber 3. The compressed air is fed through the air inlet opening 411 of the air inlet tube 41 of the actuation rod assembly 4 and the compressed air is discharged through the air output opening 44 to accumulate in the storage chamber 3. In percussion, a trigger of a toy grenade launcher is structured to push the actuation rod assembly 4 forward through the opening 33 formed in the rear end of the storage chamber 3 to disengage the first disk 42 from the first raised wall 31 of the storage chamber 3, releasing the compressed air accumulated in the storage chamber 3 to instantaneously eject the BB bullets or paintballs received in the bullet compartment 2.

Figure 4:
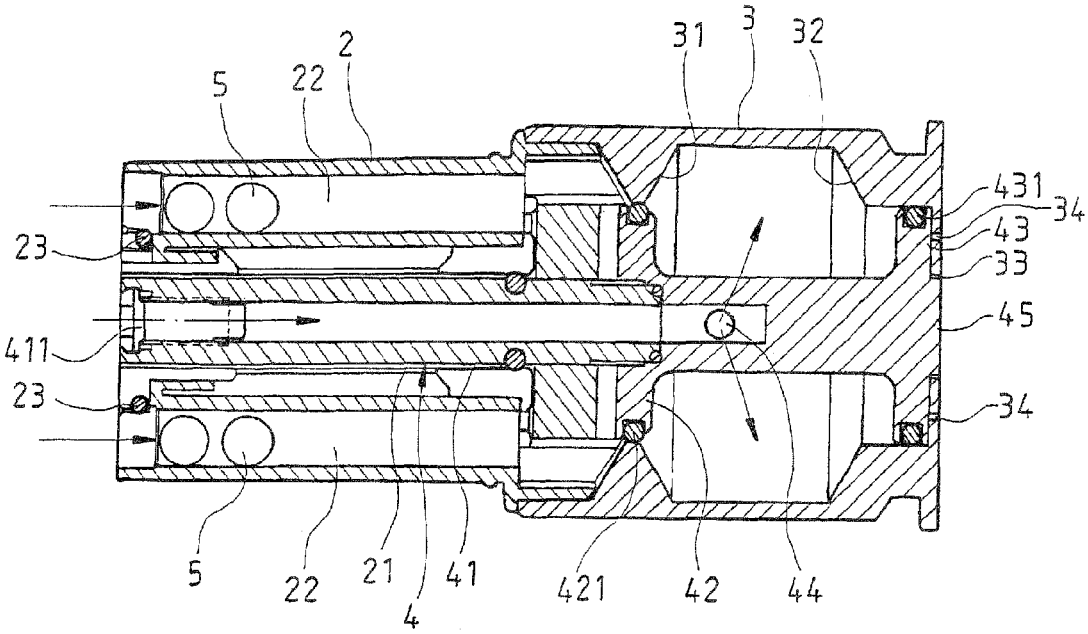
FIG. 4 is a cross-sectional view demonstrating operations of feeding air and loading BB bullets or paintballs according to the present invention.
Figure 5:
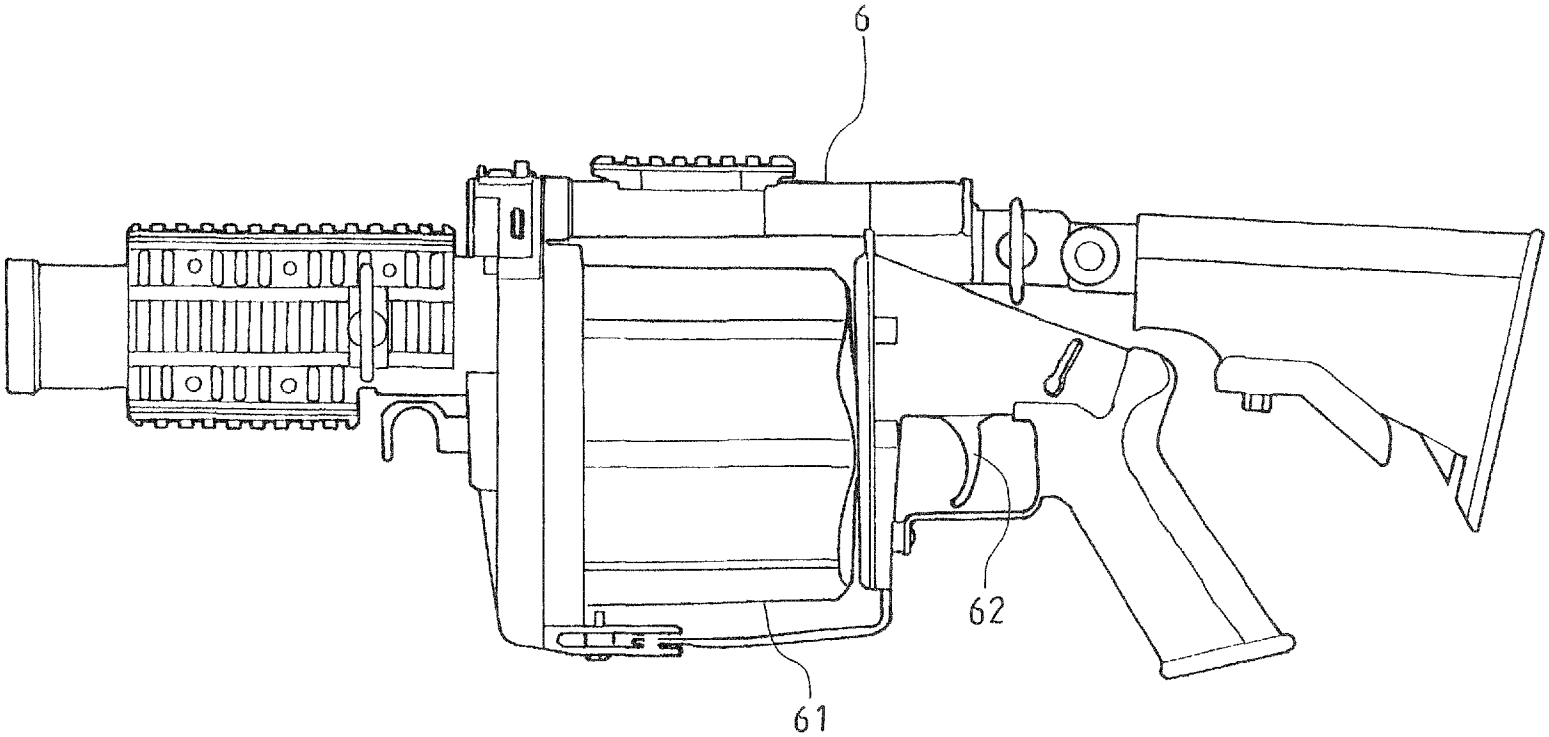
FIG. 5 is a side elevational view illustrating an application of the present invention.

Referring to FIGS. 4 and 5, which are respectively a cross-sectional view demonstrating the operations of feeding air and loading BB bullets or paintballs according to the present invention and a side elevational view illustrating an application of the present invention, as shown in these drawings, to use the present invention, compressed air is fed through the air inlet opening 411 on the front end of the air inlet tube 41 of the actuation rod assembly 4 to have the compressed air to discharge through the. Due the check valve mounted inside the air inlet opening 411 and the hermetic engagement of the gasket ring 421, 431 of the first disk 42 and the second disk 43 of the actuation rod assembly 4 with the first raised wall 31 and the second raised wall 32 of the storage chamber 3 respectively, the storage chamber 3 is hermetically sealed and the compressed air is prevented from undesired release. The BB bullets or paintballs 5 are then loaded into the bullet compartment 2 respectively through the front openings of the accommodation cylinders 22. Due to the flexible rubber rings 23 that are provided at the inner side portions of the accommodation cylinders 22, the BB bullets or paintballs 5 must be forced to move through the flexible rubber rings 23 to be put into the accommodation cylinders 22 and due to being blocked by the flexible rubber rings 23, the BB bullets or paintballs 5 are prevented from dropping off or separating. After the operations of feeding air and loading bullets, a number of grenades may then be loaded into a grenade magazine 61 of the toy grenade launcher 6 to be sequentially launched by being fired by the trigger 62 of the grenade launcher 6.

Figure 6:
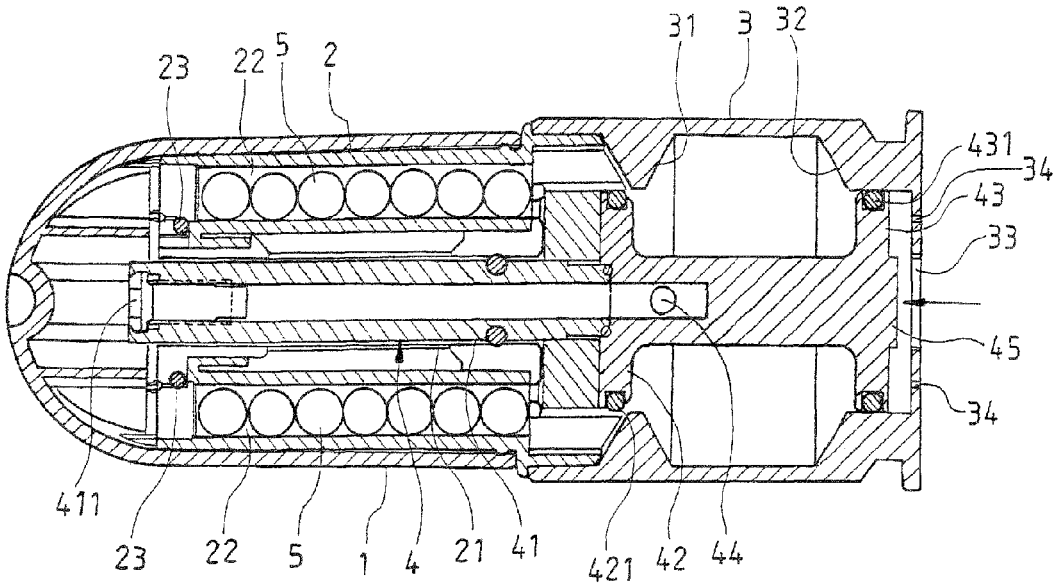
FIG. 6 is a cross-sectional view illustrating a percussion operation of the present invention.

Referring to FIG. 6, which is a cross-sectional view illustrating a percussion operation of the present invention, reference being also made to FIG. 5, as shown in these drawings, in the percussion of the present invention, the trigger 62 of the grenade launcher 6 is pulled to cause a pusher bar that is coupled to the trigger 62 to push the actuation rod assembly 4 forward through the opening 33 formed in the rear end of the storage chamber 3 to disengage the gasket ring 421 of the first disk 42 from the first raised wall 31 of the storage chamber 3, forming a gap between the storage chamber 3 and the bullet compartment 2. However, the gasket ring 431 of the second disk 43 is still kept in engagement with the second raised wall 32 of the storage chamber 3, so that compressed air inside the storage chamber 3 is only allowed to release through the gap.

Figure 7:
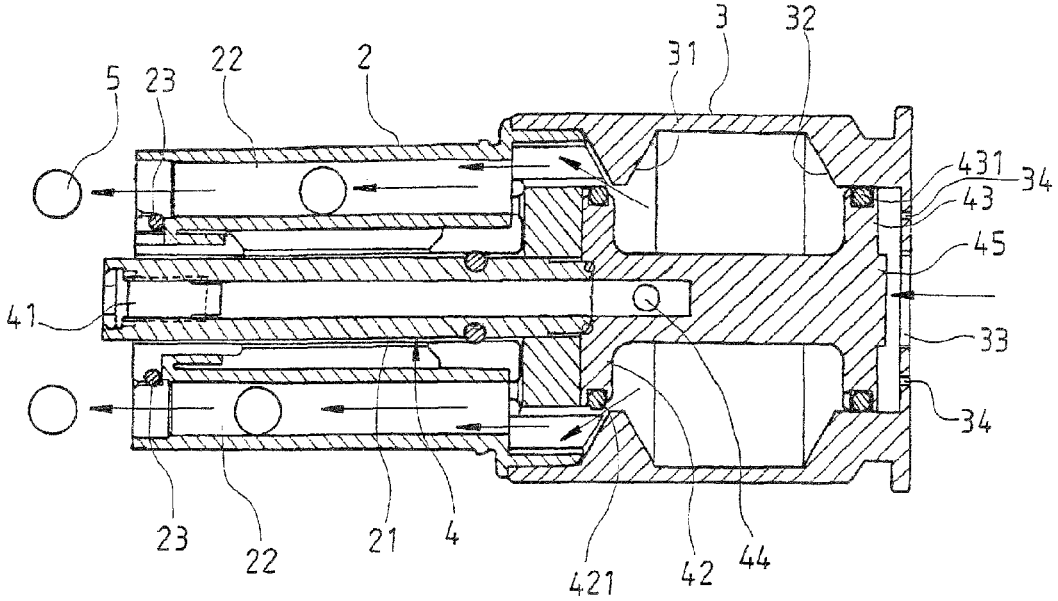
FIG. 7 is another cross-sectional view illustrating the percussion operation of the present invention.

Referring to FIG. 7, which is another cross-sectional view illustrating the percussion operation of the present invention, the drawing shows that when the actuation rod assembly 4 of the present invention is pushed forward and the gasket ring 421 of the first disk 42 is caused to disengage from the first raised wall 31 of the storage chamber 3 to form the gap between the storage chamber 3 and the bullet compartment 2, the compressed air inside the storage chamber 3 cooperates with the pressure relief apertures 34 to instantaneously release through the gap between the storage chamber 3 and the bullet compartment 2 and enter each of the accommodation cylinders 22 of the bullet compartment 2 thereby instantaneously eject the BB bullets or paintballs 5 contained in each accommodation cylinder 22 of the bullet compartment 2 to simultaneously shoot a number of BB bullets or paintballs 5.

Figure 8:
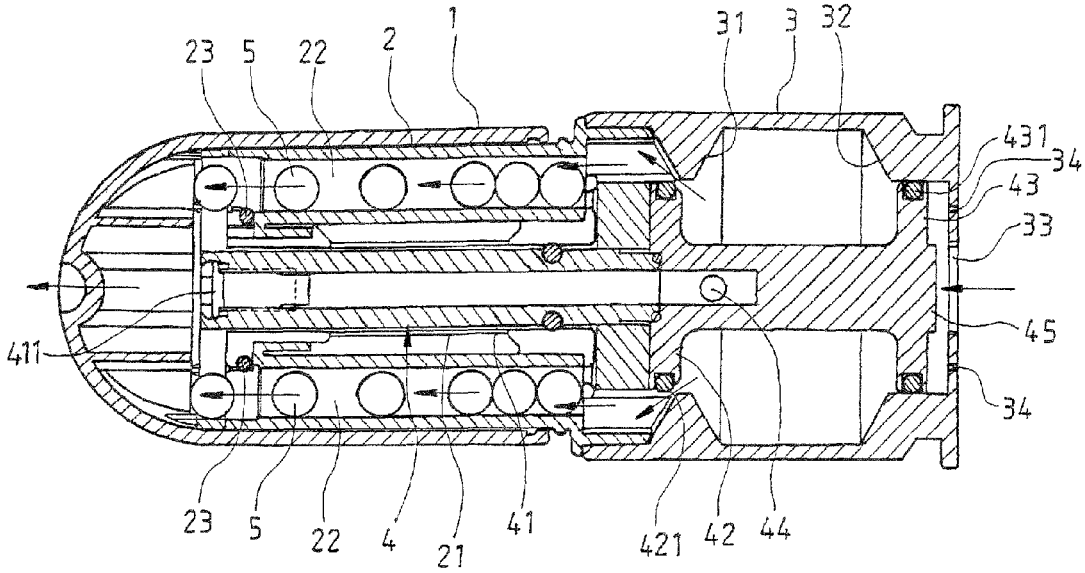
FIG. 8 is a further cross-sectional view illustrating the percussion operation of the present invention.

Referring to FIG. 8, which is a further cross-sectional view illustrating the percussion operation of the present invention, the drawing shows that when the actuation rod assembly 4 of the present invention is pushed forward and the gasket ring 421 of the first disk 42 is caused to disengage from the first raised wall 31 of the storage chamber 3 to form the gap between the storage chamber 3 and the bullet compartment 2, the compressed air inside the storage chamber 3 cooperates with the pressure relief apertures 34 to instantaneously release through the gap and enter each of the accommodation cylinders 22 of the bullet compartment 2, whereby besides instantaneously ejecting the BB bullets or paintballs 5 contained in each accommodation cylinder 22 of the bullet compartment 2 to simultaneously shoot a number of BB bullets or paintballs 5, the BB bullets or paintballs 5 are also shot together with the front cap 1 so as to provide another way of shooting.

In summary the present invention comprises a bullet compartment that forms a plurality of accommodation cylinders to work with a storage chamber that stores compressed air therein and a movable actuation rod assembly to constitute a grenade for toy gun, whereby compressed air is fed into the grenade and stored in the storage chamber to allow the compressed air stored inside the storage chamber to instantaneously eject the BB bullets or paintballs contained in the bullet compartment. The operation is easy and convenient.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A grenade for a toy gun, comprising:

a front cap;

a bullet compartment, which comprises a centrally-formed through bore, which has a circumference around which a plurality of circumferentially arranged accommodation cylinders is arranged to allow each of the accommodation cylinders to receive, via a front opening thereof, and load BB bullets or paintballs therein;

a storage chamber, which is in communication with the bullet compartment and is delimited by a first raised wall and a second raised wall respectively at front end and rear end thereof;

an actuation rod assembly, which is hollow and is received in the central through bore of the bullet compartment and comprises an air inlet tube arranged at a front side thereof, the air inlet tube having a front end forming an air inlet opening and a rear end to which a first disk and a second disk are mounted, an air output opening being formed between the first disk and the second disk, the first disk and the second disk each having a circumference around which a gasket ring is mounted to set the gasket rings in engagement with the first raised wall and the second raised wall of the storage chamber so as to hermetically seal the storage chamber, whereby compressed air is allowed to feed through the air inlet opening of the air inlet tube and the compressed air is discharged through the air output opening to accumulate in the storage chamber and whereby in percussion, a trigger of a toy grenade launcher is structured to push the actuation rod assembly forward to disengage the first disk from the first raised wall of the storage chamber so as to release the compressed air in the storage chamber to instantaneously eject the BB bullets or paintballs received in the bullet compartment.

2. The grenade according to claim 1, wherein the storage chamber has a rear end forming an opening, the actuation rod assembly having a rear end forming a projection that is receivable in the opening of the storage chamber for positioning purposes.

3. The grenade according to claim 2, wherein pressure relief apertures are formed on sides of the opening.

4. The grenade according to claim 1, wherein each of the accommodation cylinders of the bullet compartment has an inner side portion which is provided with a flexible rubber ring, whereby the BB bullets or paintballs are forcibly movable through the flexible rubber ring to be positioned into each of the accommodation cylinders, the flexible rubber rings blocking and preventing the BB bullets or paintballs from dropping off.

5. The grenade according to claim 1, wherein the air inlet opening formed in the front end of the air inlet tube of the actuation rod assembly is provided with a check valve mounted therein.

* * * * *